US006939516B2

(12) United States Patent
Hall et al.

(10) Patent No.: US 6,939,516 B2
(45) Date of Patent: Sep. 6, 2005

(54) MULTI-WELL PLATE COVER AND ASSEMBLY ADAPTED FOR MECHANICAL MANIPULATION

(75) Inventors: John P. Hall, Raleigh, NC (US); Andrew P. Muser, Durham, NC (US); Kenneth W. Whitley, Raleigh, NC (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 189 days.

(21) Appl. No.: 09/920,496

(22) Filed: Aug. 1, 2001

(65) Prior Publication Data

US 2002/0039545 A1 Apr. 4, 2002

Related U.S. Application Data

(60) Provisional application No. 60/236,391, filed on Sep. 29, 2000.

(51) Int. Cl.[7] ..... B01L 3/02

(52) U.S. Cl. ..... 422/102; 422/99; 435/305.3; 435/305.4; 206/503; 220/23.6

(58) Field of Search ..... 206/372, 373, 206/503; 220/4, 23.6; 435/305.2, 305.3, 305.4; 422/99–104, 129–131

(56) References Cited

U.S. PATENT DOCUMENTS

| | | | | |
|---|---|---|---|---|
| 2,825,466 A | * | 3/1958 | Shnitzler et al. | 211/49.1 |
| 4,626,509 A | | 12/1986 | Lyman | |
| 4,719,087 A | | 1/1988 | Hanaway | |
| 4,751,184 A | | 6/1988 | Higo et al. | |
| 4,777,021 A | | 10/1988 | Wertz et al. | |
| 4,895,706 A | | 1/1990 | Root et al. | |
| 4,927,604 A | | 5/1990 | Mathus et al. | |
| 4,948,564 A | | 8/1990 | Root et al. | |
| 4,963,493 A | * | 10/1990 | Daftsios | 422/104 |
| 5,047,215 A | * | 9/1991 | Manns | 422/101 |
| 5,056,427 A | | 10/1991 | Sakabe et al. | |
| 5,273,718 A | | 12/1993 | Skold et al. | |
| 5,282,543 A | * | 2/1994 | Picozza et al. | 220/255 |
| 5,342,581 A | | 8/1994 | Sanadi | |
| 5,344,202 A | | 9/1994 | Ramler et al. | |
| 5,364,790 A | * | 11/1994 | Atwood et al. | 435/287.2 |
| 5,540,891 A | | 7/1996 | Portmann et al. | |
| 5,587,321 A | | 12/1996 | Smith et al. | |
| 5,604,130 A | | 2/1997 | Warner et al. | |
| 5,700,128 A | | 12/1997 | Tonnigs et al. | |
| 5,741,402 A | | 4/1998 | Tokhan et al. | |
| 5,741,463 A | | 4/1998 | Sanadi | |
| 5,851,346 A | | 12/1998 | Hitch | |
| 5,851,492 A | | 12/1998 | Blattner | |
| 5,944,093 A | | 8/1999 | Viswanath | |
| 5,946,886 A | | 9/1999 | Bealer | |
| 6,103,199 A | * | 8/2000 | Bjornson et al. | 422/100 |
| 6,159,368 A | * | 12/2000 | Moring et al. | 210/321.75 |
| 6,171,554 B1 | * | 1/2001 | Kalmakis et al. | 422/104 |
| 6,193,064 B1 | * | 2/2001 | Finneran | 206/443 |
| 6,197,572 B1 | | 3/2001 | Schneebeli | |
| 6,254,833 B1 | * | 7/2001 | Shumate et al. | 422/102 |
| 6,361,746 B1 | * | 3/2002 | Wlodarski | 422/104 |
| 6,379,626 B1 | * | 4/2002 | Munson et al. | 422/102 |
| 6,426,050 B1 | * | 7/2002 | Pham et al. | 422/104 |
| 6,426,215 B1 | * | 7/2002 | Sandell | 435/305.3 |
| 6,436,351 B1 | * | 8/2002 | Gubernator et al. | 422/102 |
| 6,486,401 B1 | * | 11/2002 | Warhurst et al. | 174/66 |
| 6,518,060 B2 | * | 2/2003 | Heimberg et al. | 435/305.3 |

FOREIGN PATENT DOCUMENTS

| | | | |
|---|---|---|---|
| DE | 40 16 617 A1 | | 11/1991 |
| EP | 0 388 159 A2 | * | 9/1990 |
| WO | WO 95/27196 | | 10/1995 |

* cited by examiner

*Primary Examiner*—Jill Warden
*Assistant Examiner*—Dwayne K Handy

(57) ABSTRACT

A multi-well plate cover and assembly comprises a lid and a gasket. The lid is formed of a resilient material and configured to apply a compressive spring force to the surface of the gasket to seal the wells in a multi-well plate when the cover is secured to the multi-well plate. The lid has members for mechanical manipulation and for attachment to the multi-well plate.

25 Claims, 12 Drawing Sheets

MULTI-WELL PLATE COVER AND ASSEMBLY ADAPTED FOR MECHANICAL MANIPULATION

This application claims domestic priority from Provisional Patent Application No. 60/236,391, Filed: Sep. 29, 2000.

BACKGROUND OF THE INVENTION

1. Field of the Invention

The present invention relates to an improved multi-well plate cover of the type typically used in the laboratory science fields of biology, chemistry and pharmaceutical research to cover multi-well plates. More specifically, the improved cover and assembly is adapted for improved sealing function and for mechanical manipulation by robotic or other mechanical means.

2. Description of the Related Art

In the areas of biological, chemical and pharmaceutical research, it is a common practice to utilize multi-well plates for storage and analytical purposes. Generally these plates, normally constructed of plastic materials, have a 3"×5" footprint and contain from 12 to 1536 wells organized in rows. The individual well geometry of a multi-well plate can vary between round and square, with contained volumes from 1 microliter to 200 microliters. The plates are particularly suited to the use of laboratory automation for the handling, storage and assay of chemical and biological entities.

The multi-well plates, being liquid-filled and subject to storage, have a number of lidding options available to the user. The simplest form of cover is a molded plastic lid that loosely fits over the multi-well plate. For some researchers this may provide an adequate seal, but other researchers may require a more robust cover that provides for protection from both the ingress and egress of materials into the individual wells. The nature of ingression can include the absorbence of material such as water in the presence of DMSO (dimethyl sulfoxide), a preferred storage solvent with a hygroscopic nature, and transfer of materials between wells. Egression can include the loss of volume due to evaporation or sublimation.

Another form of lidding is that of an adhesive seal type cover such as Costar® Thermowell™ sealers (Catalog No. 6570). An adhesive seal is approximately 3"×5" and consists of a substrate material such as a thin foil or plastic film to which an adhesive has been applied. These seals can be applied by mechanical or manual means. The adhesive seal is removed by hand as there is no mechanical device for removal. The adhesive seal provides superior sealing properties in contrast to the plastic lid but has a number of deficiencies: (1) it can only be used once; (2) its adhesive can come in contact with the stored entity; and (3) during removal if any of the stored entity is on the inner surface of the seal, it may be problematic for worker safety. Additionally, if repeated seals are applied to the same multi-well plate the adhesive tends to build up, compromising the seals of successive applications.

Yet another form of lidding is the use of a heat-sealed cover such as the Abgene Easy Peel Polypropylene Sealing Film (Catalog No. AB-0745). A heat-sealed cover is 3"×5" and consists of a substrate material such as polypropylene film. Most of the multi-well plates used for storage are polypropylene. With the application of heat and pressure by means of an Abgene Combi Thermal Sealer, the heat-sealed cover can be bonded to the polypropylene multi-well plate on the plate's upper surface. This seal is in essence a molecular bond caused by the melting of the polypropylene of the respective entities. As such, the heat seal cover sets the standard for multi-well plate sealing in terms of protection from both the ingress and egress of materials into the individual wells. It can be applied by manual and mechanical means such as the Abgene 1000, a semi-automatic applicator that uses roll stock of the Abgene Easy Peel Sealing Film. However, there is no mechanical device for the removal of heat-sealed covers. Heat-sealed covers cannot be reused. Each time a heat-sealed cover is attached to the plate there can be distortion on the standoffs of the individual wells, plus polypropylene remnants, affecting the quality of future seals on the same plate.

Examples of mechanical coverage of multi-well plates are disclosed in U.S. Pat. No. 5,342,581 entitled "Apparatus for Preventing Cross Contamination of Multi-Well Test Plates", issued Aug. 30, 1994, in the name of Sanadi; U.S. Pat. No. 5,516,490 entitled "Apparatus for Preventing Cross Contamination of Multi-Well Test Plates", issued May 14, 1996, in the name of Sanadi; and U.S. Pat. No. 5,741,463 entitled "Apparatus for Preventing Cross Contamination of Multi-Well Test Plates", issued Apr. 21, 1998, in the name of Sanadi; the disclosures of which are incorporated herein by reference.

Another example of mechanical coverage of multi-well plates is disclosed in a brochure entitled "SealTite Microplate Cover" from TekCel Corporation, Martinsville, N.J. Additional information on the "SealTite Microplate Cover" can be found on the WWW site "www.tekcel.com/sealtite.htm", Copyright ©1998 TekCel Corporation.

SUMMARY OF THE INVENTION

The subject invention is directed toward the repeated effective sealing and unsealing of multi-well plates utilizing mechanical manipulation. As noted above, there are a number of approaches to sealing multi-well plates. In the adhesive and thermal bonding approaches, a sealing mechanism is used to bond (either thermally or with an adhesive) a film over the wells of a multi-well plate to create an air and fluid barrier. While adequate for a single bonding instance, film approaches do not lend themselves to the requirement to access the multi-well plate multiple times in automation-based plate handling systems.

In the mechanically-based lid systems referenced above, the art describes the use of resilient materials which are pressed against the upper surface of the multi-well plate. These approaches also employ lids with clamps to secure the resilient material against the upper surface of the multi-well plate. An important requirement for this type of sealing is the ability to apply a normal force to the resilient material in a uniform manner.

In the invention described herein, the source of the compressive force is the lid itself by means of a curvilinear section of the lid which can provide a spring force when deformed, thereby applying a normal force more or less equally to the planar surface of a gasket which in turn seals the individual wells of a multi-well plate. Perpendicular side walls of the lid, which can be displaced laterally, are used to attach the lid to the multi-well plate. In this manner, a multi-well plate can be accessed multiple times by displacing the side walls and removing the cover.

The invention described herein is particularly adapted to work with robotic systems, which can use mechanical devices to secure the cover, apply it to a multi-well plate and remove the cover if desired.

DETAILED DESCRIPTION

Figure 1:
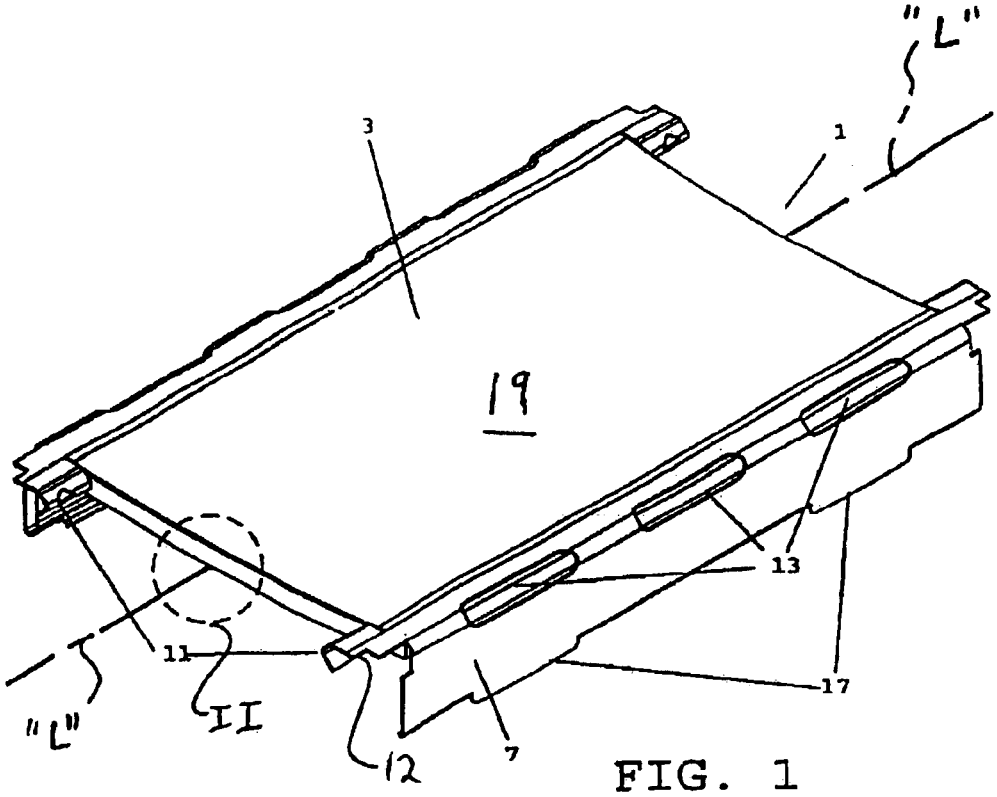
FIG. 1 is a perspective view of a preferred embodiment of the invention showing a multi-well plate cover designated 1, a lid 3, side walls 7 of said lid 3, notched tabs 12 with locator holes 11 of lid 3, stacking locators (slots) 13 of lid 3, and stacking lugs 17 of lid 3.
Figure 2:
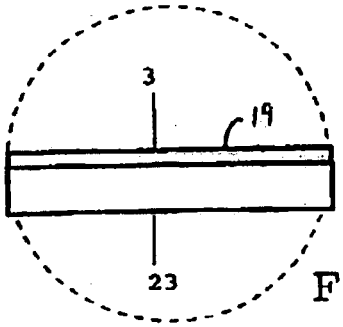
FIG. 2 is an end view of a portion of multi-well plate cover 1 of FIG. 1 designated by Roman numeral II in FIG. 1, showing lid 3 of multi-well plate cover 1 and an uncompressed gasket 23 disposed on the underside of lid 3.

Referring now more particularly to the drawings, a multi-well plate cover generally designated 1 in FIG. 1 comprises a one-piece metal lid 3 which is fabricated by conventional metal fabrication techniques employing the cutting, stamping and/or bending of sheet metal. Suitable metals include steel, spring steel, stainless steel and stainless spring steel, preferably having a thickness between about 0.015" and 0.024". The metallic design provides a high degree of chemical resistance, especially to dimethyl sulfoxide, the solvent most commonly used in multi-well plate storage. Included as part of the lid 3 are the side walls 7, integral to and formed at approximately 90 degrees to the top surface of lid 3; the notched tabs 12 with locator holes 11 integral with and extending from lid 3; stacking locators (slots) 13; and stacking locator lugs 17. The slots 13 configured to accent corresponding lugs 17 of a second cover 1 stacked over a first cover 1 (see FIG. 14) and thus align the covers laterally and longitudinally. FIG. 2 shows a planar, uncompressed gasket 23 disposed on the convex side of a curvilinear section 19 of lid 3, covering the surface thereof in sufficient area to fully engage the upper surface of a multi-well plate. Gasket 23 is preferably made from a low-durometer (Shore ISA or less) thermoplastic polymer or elastomer with a thickness of approximately 3/32" or 0.100". Gasket 23 is manufactured using standard injection molding or extrusion technology, and is preferable affixed by an adhesive to the bottom surface of the lid 3. A preferred gasket material is SYNPRENE 5A manufactured by Polyone. FIG. 1 also shows a longitudinal axis "L" of the cover 1 parallel to the side walls 7.

Figure 3:
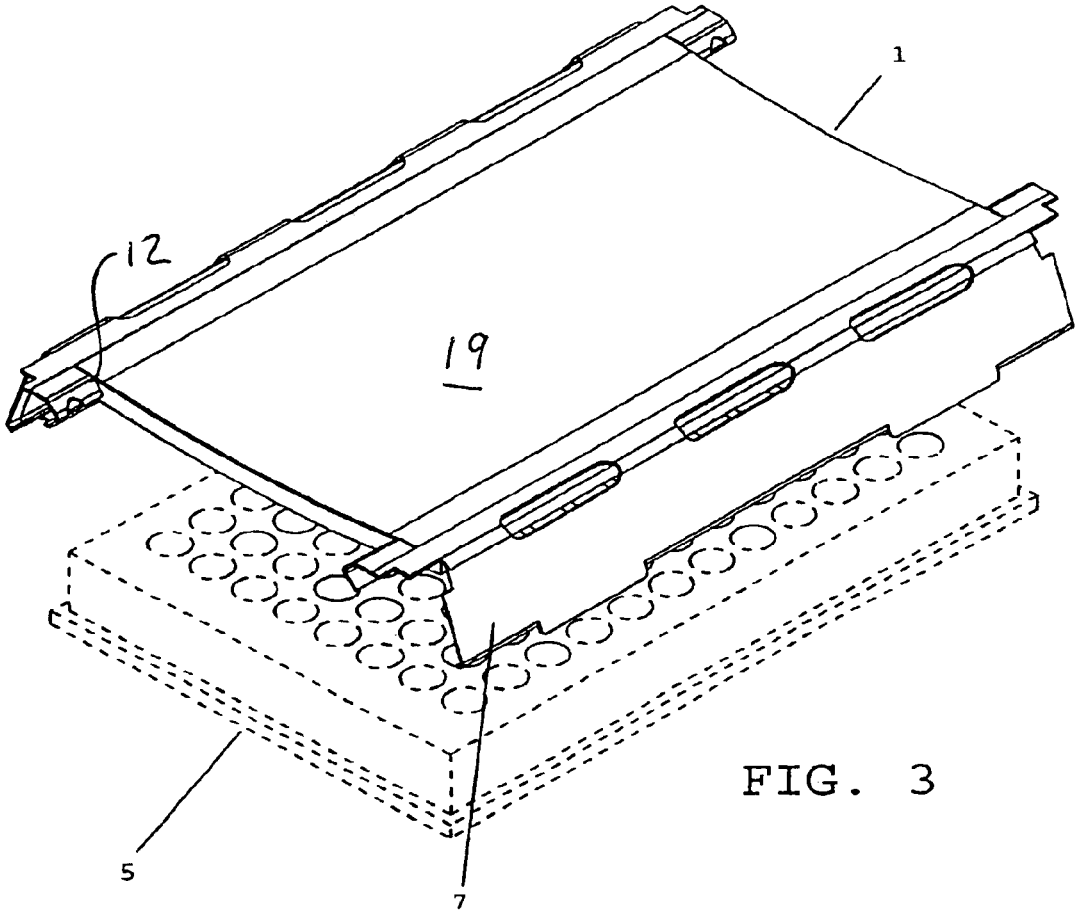
FIG. 3 is a perspective view of multi-well plate cover 1 of FIG. 1 positioned over a multi-well plate 5 (shown in dashed line), with side walls 7 extended in preparation for attachment to multi-well plate 5.
Figure 4:
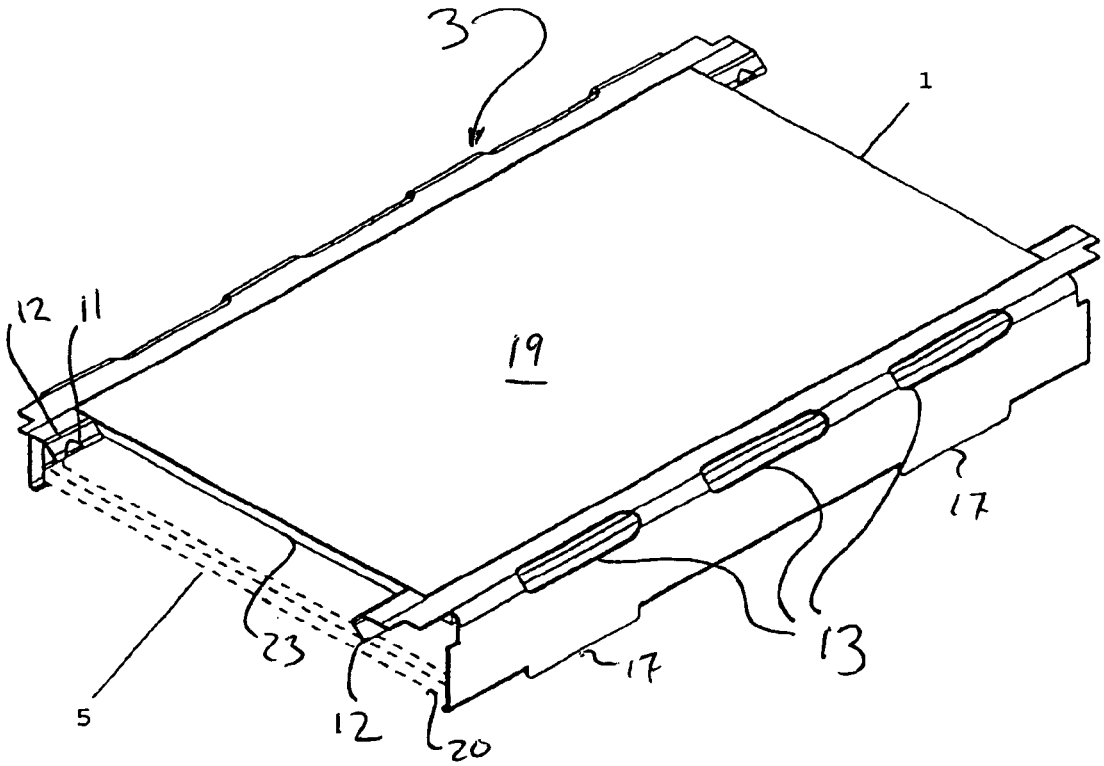
FIG. 4 is a perspective view of multi-well plate cover 1 of FIG. 1 attached to a multi-well plate 5.

FIG. 3 shows multi-well plate cover 1, with side wall 7 laterally displaced in preparation for attachment to a multi-well plate 5. The lateral displacement of side walls 7 is accomplished by mechanical means which is not shown in FIG. 3 for illustrative purposes, but is shown in FIGS. 10–12. Similarly, the means for gripping multi-well plate cover 1 and for placing multi-well plate cover 1 on multi-well plate 5 are not shown in FIG. 3 but are shown in FIGS. 9–13. FIG. 4 shows multi-well plate cover 1 attached to a multi-well plate 5 (shown in dashed line) in the normal storage mode.

Figure 5:
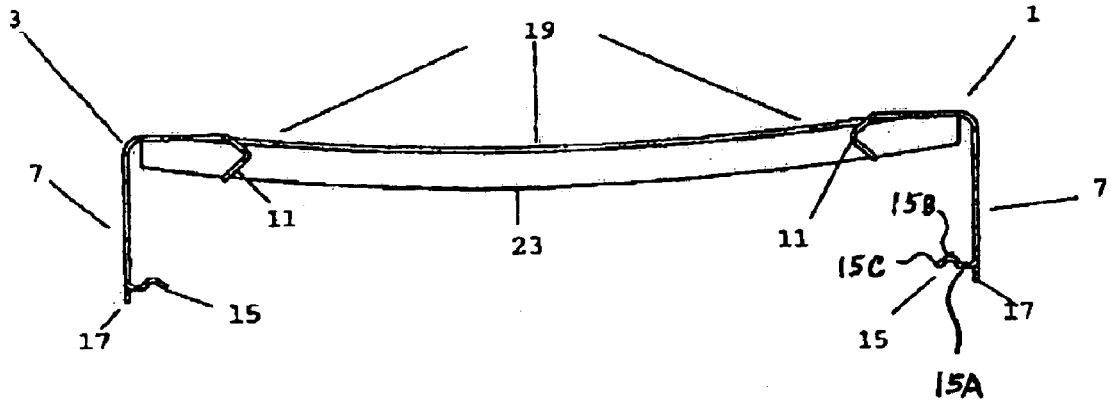
FIG. 5 is an end view of multi-well plate cover 1, showing a curvilinear spring section 19 of lid 3, side walls 7 of lid 3, stacking lugs 17 of said lid 3, notched tabs 12 with locator holes 11 of lid, multi-well plate holders 15 of lid 3 and uncompressed gasket 23.
Figure 6:
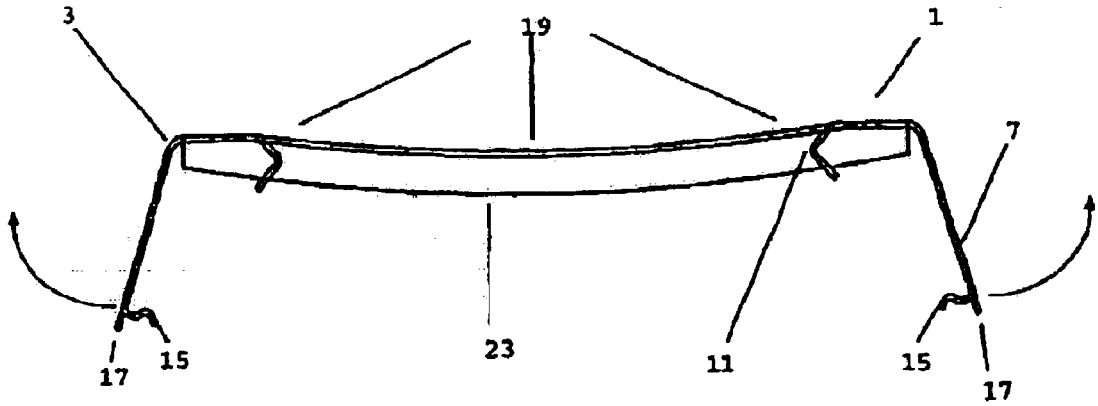
FIG. 6 is a view similar to FIG. 5 in which side walls 7 are laterally displaced outward.
Figure 7:
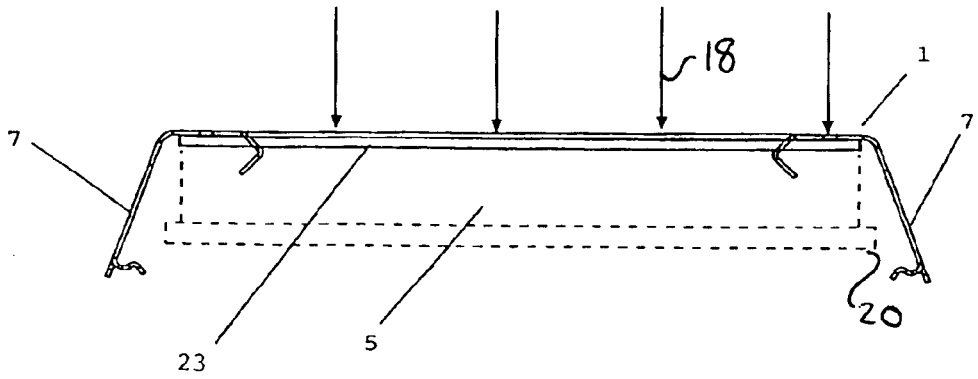
FIG. 7 is a view similar to FIG. 6, in which multi-well plate cover 1 is pressed against a multi-well plate 5 to compress gasket 23 while side walls 7 remain laterally displaced.
Figure 8:
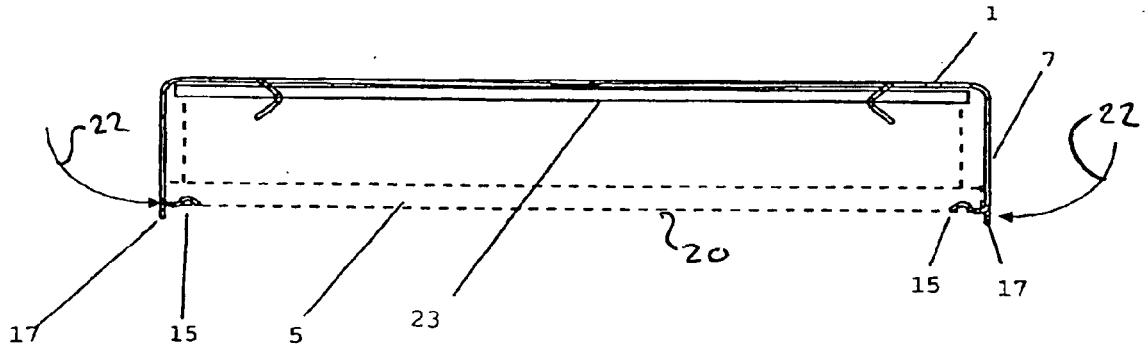
FIG. 8 is a view similar to FIG. 7, in which multi-well plate cover 1 abuts and extends over multi-well plate 5 to compress gasket 23. Side walls 7 secure multi-well plate cover 1 to multi-well plate 5 by means of multi-well plate holders 15.

FIG. 5 is an end view of multi-well plate cover 1 and serves to illustrate the spring nature of multi-well plate cover 1. FIG. 6 is also an end view of multi-well plate cover 1 and depicts the displacement of side walls 7 of multi-well plate cover 1 in preparation for attachment to a multi-well plate (not shown in FIG. 6). FIG. 7 shows a continuation of the process of attaching multi-well plate cover 1 to a multi-well plate 5 (in phantom) in which multi-well plate cover 1 is vertically pressed in the direction shown by arrows 18 onto multi-well plate 5, causing the compression of uncompressed gasket 23 onto the upper surface of multi-well plate 5 while side walls 7 are outwardly extended. FIG. 8 shows a continuation of the process of attaching the multi-well plate cover 1 to multi-well plate 5 in which multi-well plate cover 1 having been placed in contact with the upper surface of multi-well plate 5 has side walls 7 released into their normal position in which multi-well plate holders or clamps 15 engage a skirt 20 of multi-well plate 5 by moving in the direction of arrows 22. The engagement of multi-well plate holders 15 with skirt 20 exerts a downward force on the ends of curvilinear section 19 to exert a compressive force on gasket 23. In the embodiment of FIG. 5 the multi-well plate holders or clamps 15 project (extend) inwardly from respective side walls 7 and each have a first portion 15A proximal to the side wall from which the respective multi-well plate holder or clamp 15 extends and a second relatively distal portion 15B having a convex transverse (lateral) cross-section (transverse relative to the longitudinal axis "L" of the cover 1) such that a distal end 15C of the respective multi-well plate holder or clamp 15 is directed generally downwardly. FIG. 5 also shows the stacking locator lugs 17 project downwardly from the side walls 7 a distance lower than the multi-well plate holders or clamps 15. FIG. 8 shows the pair of side walls 7 extend downwardly from the cover 1 a sufficient length for the multi-well plate holders or clamps 15 to contact the multi-well plate 5 from underneath by contacting a lower surface of the multi-well plate 5 in a grasping position. The multi-well plate holders or clamps 15 being located a sufficient distance from the upper edge of their respective side wall 7 to downwardly urge peripheral sides, of the cover 1, integral with the sidewalls 7.

Figure 9:
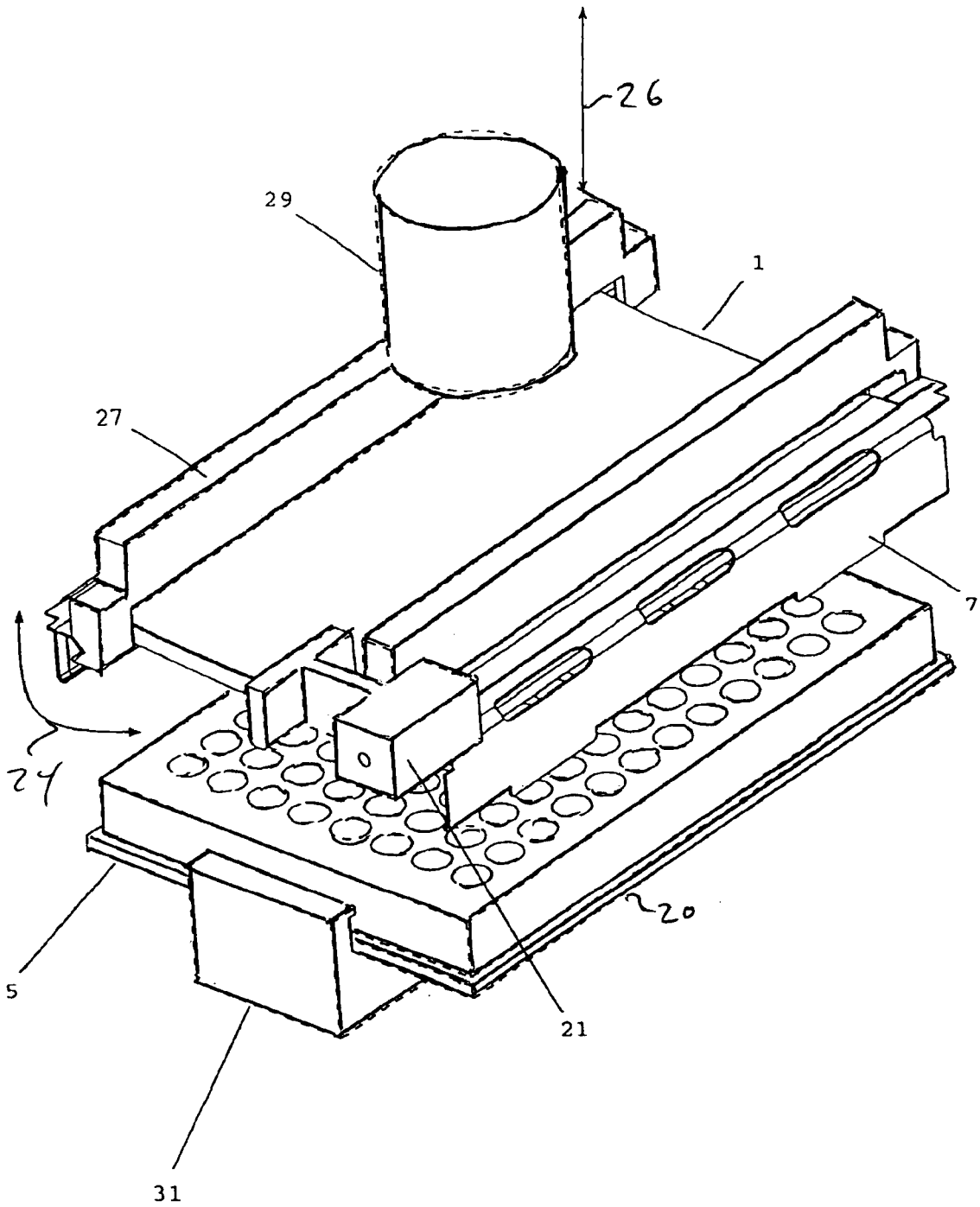
FIG. 9 is a perspective view showing means which could be used to perform the mechanical actions in attaching multi-well plate cover 1 to a multi-well plate 5. Means 31 is shown for holding multi-well plate 5 during covering and uncovering; means 29 is shown for vertical movement of multi-well plate cover 1 and compression of multi-well plate cover 1; means 21 is shown for laterally displacing side walls 7; and means 27 is shown for gripping multi-well plate cover 1.
Figure 10:
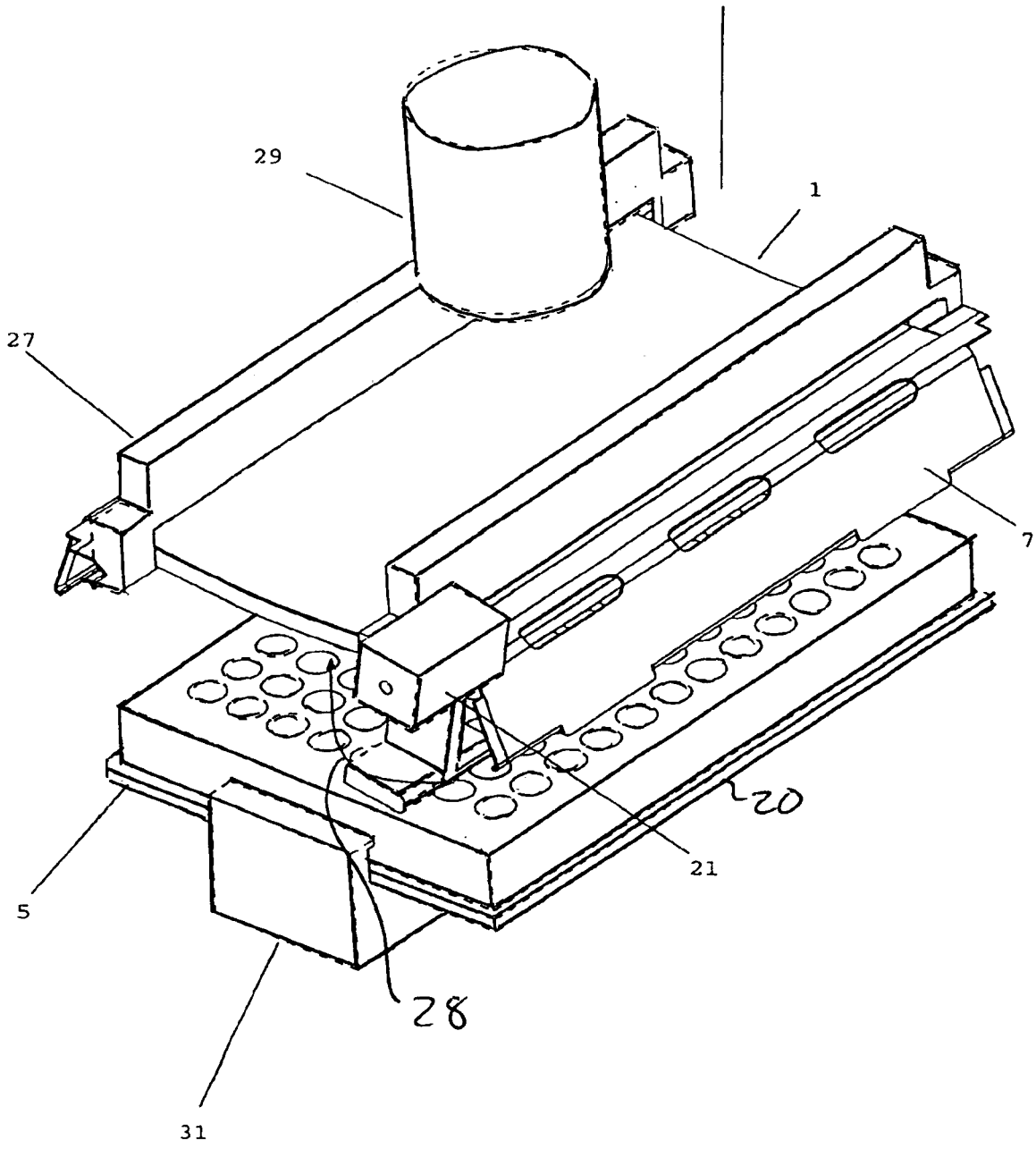
FIG. 10 is a view similar to FIG. 9 showing means 21 laterally displacing side walls 7 of lid 3 of multi-well plate cover 1.
Figure 11:
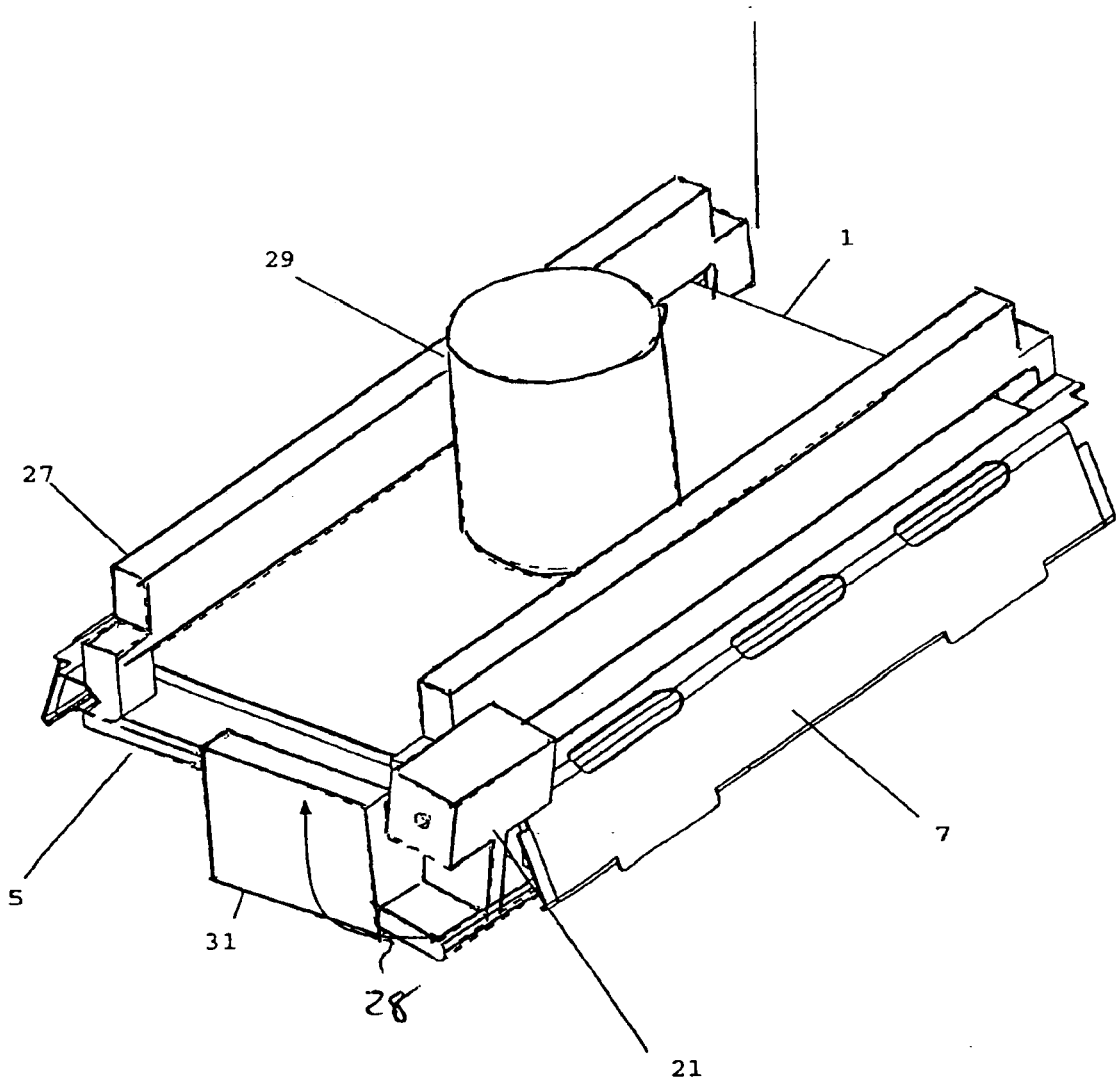
FIG. 11 is a view similar to FIG. 10 showing means 29 vertically placing multi-well plate cover 1 on multi-well plate 5 held by means 31, while means 21 maintains side walls 7 in a laterally displaced position.
Figure 12:
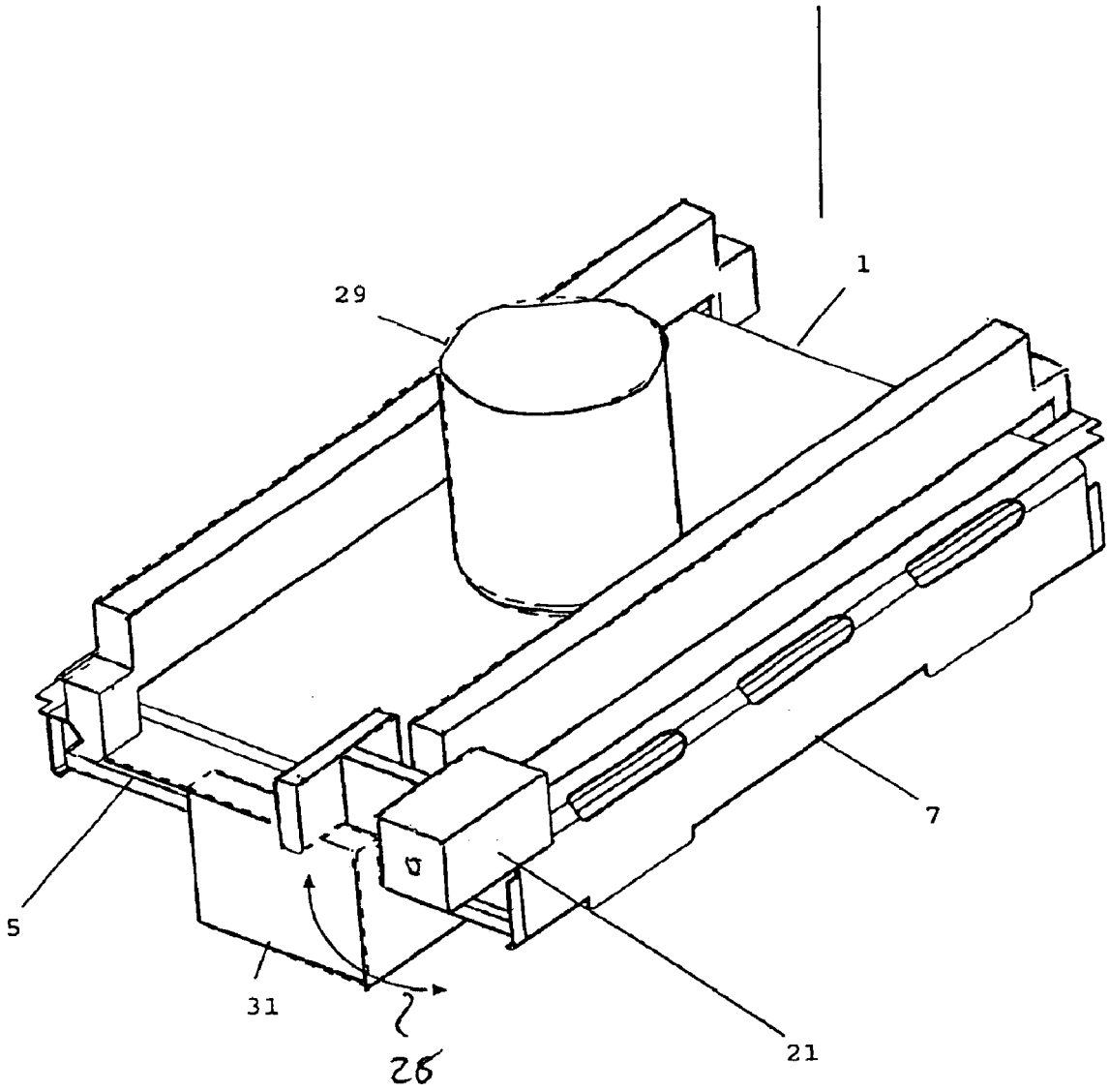
FIG. 12 is a view similar to FIG. 11 showing means 21 releasing side walls 7 of lid 3 of multi-well plate cover 1, thereby securing multi-well plate cover 1 to multi-well plate 5.
Figure 13:
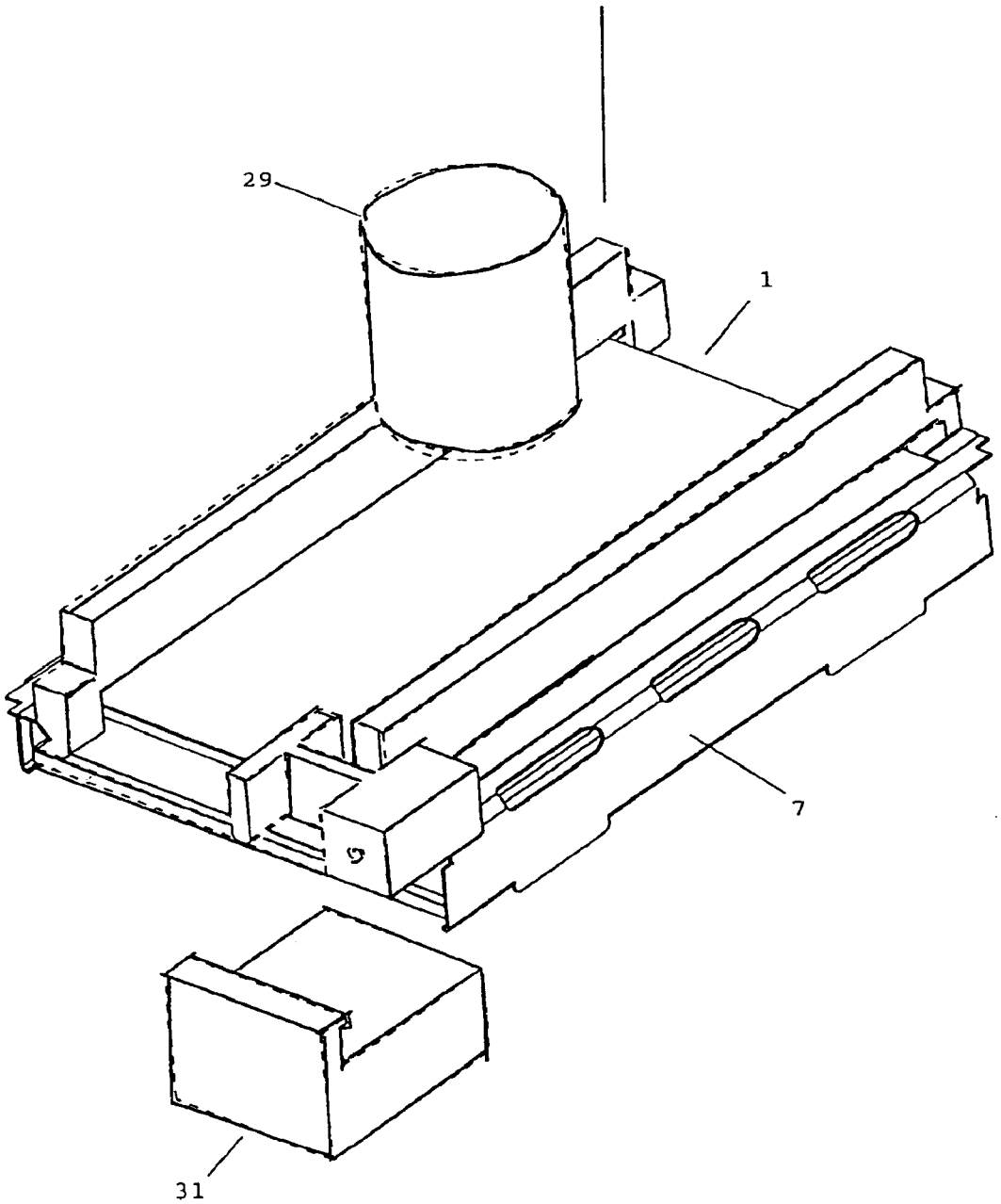
FIG. 13 is a view similar to FIG. 12 showing means 29 vertically moving multi-well plate cover 1 attached to multi-well plate 5.
Figure 14:
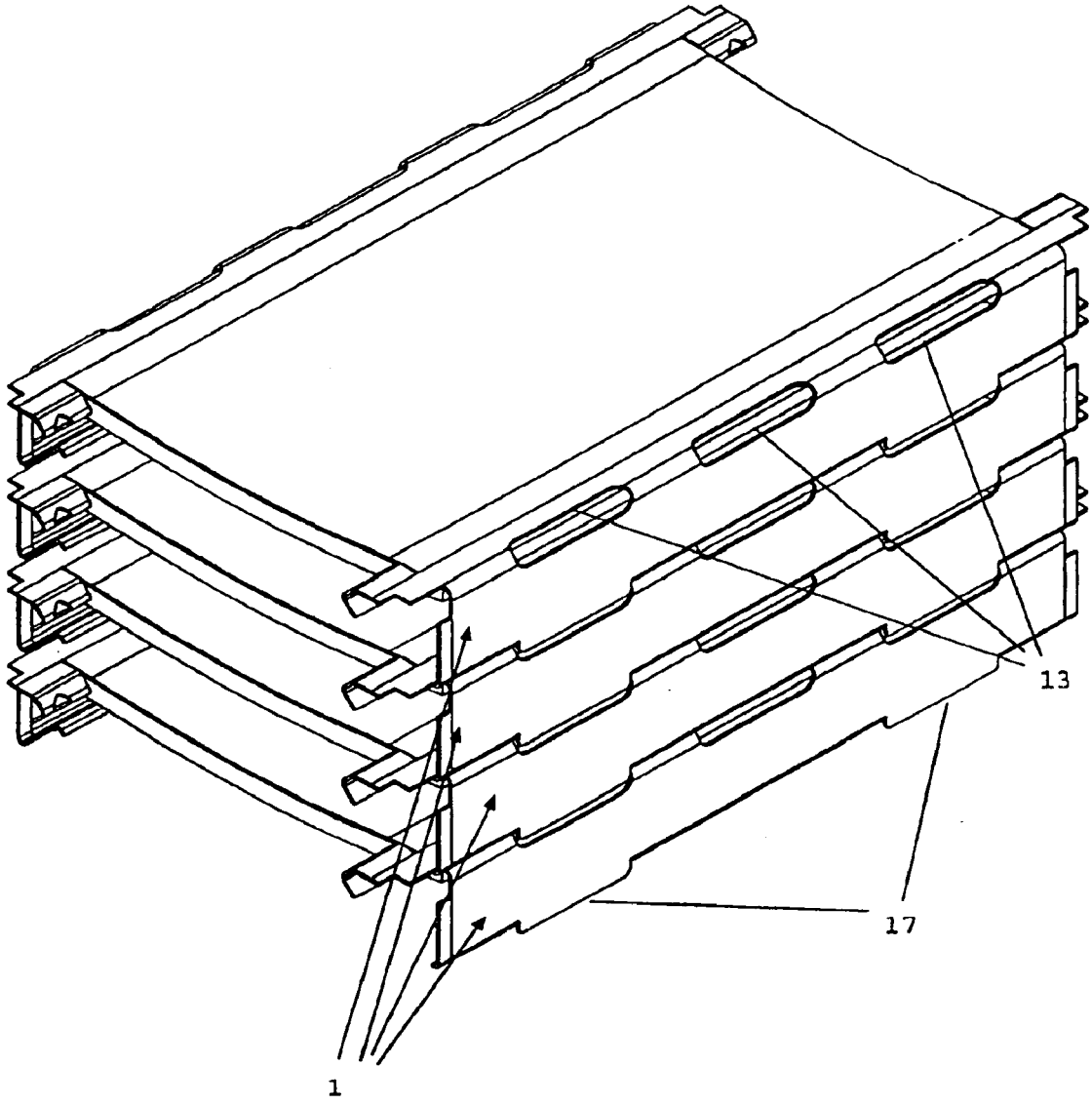
FIG. 14 is a perspective view of several multi-well plate covers 1 in a stacked orientation utilizing stacking lugs 17 and stacking locators 13.

FIG. 9 through FIG. 13 show how a mechanical system such as an automated plate server would function with multi-well plate cover 1. In FIG. 9, a multi-well plate 5 is shown held by means 31 in preparation for attachment of multi-well plate cover 1. Means 21 is shown for laterally displacing side walls 7 in the direction shown by arrow 24, and means 27 is shown for gripping multi-well plate cover 1. Means 29 provides for the positioning of multi-well plate cover 1 in the direction shown by arrow 26. FIG. 10 shows means 21 laterally displacing side walls 7 in the direction shown by arrow 28 in preparation for attachment of multi-well plate cover 1. Continuing with the sequence, FIG. 11 shows multi-well plate cover 1 placed on the upper surface of multi-well plate 5. This action also serves to compress the uncompressed gasket 23 shown in FIG. 6 to produce the compressed gasket 23 shown in FIG. 7. In FIG. 12, means 21 is shown releasing side walls 7 so the multi-well plate holders 15, as FIG. 8, can engage and secure skirt 20 of multi-well plate 5. FIG. 13, completing the sequence, shows multi-well plate cover 1 attached to multi-well plate 5 being moved by means 29. In FIG. 14, a stack of multi-well plate covers 1 is shown arranged vertically. The interaction of the stacking locators 13 and stacking lugs 17 of adjacent multi-well plate cover 1 provides stability and geometric alignment of the stack. Because multi-well plate covers 1 are normally used in automation based systems, a geometrically constrained stack is important to the pick and place robotic manipulation.

Figure 15:
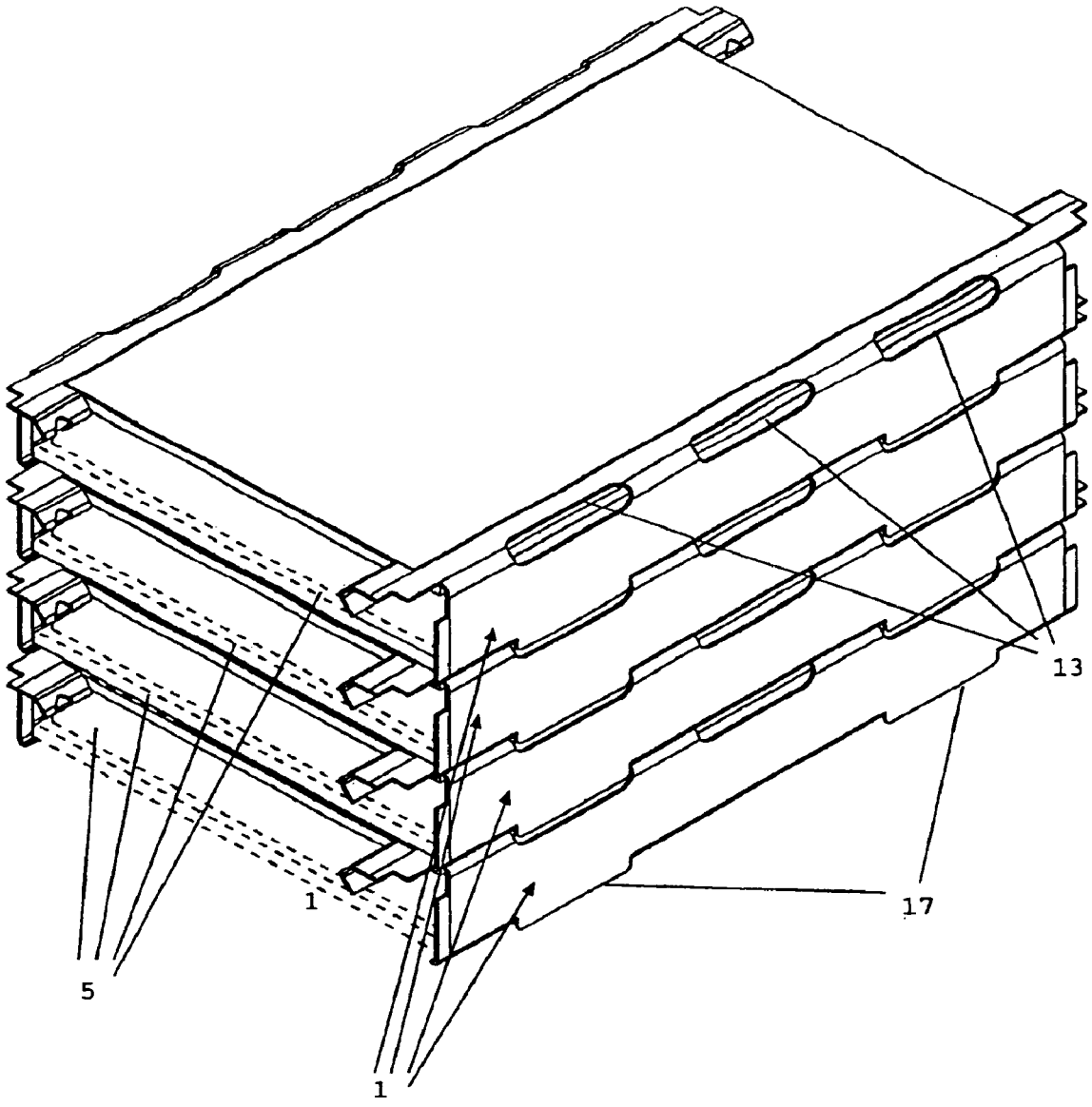
FIG. 15 is a perspective view of several multi-well plate covers 1 and multi-well plates 5 in a stacked orientation utilizing stacking lugs 17 and stacking locators 13.

FIG. 15, a stack of multi-well plate covers 1 attached to multi-well plates 5 is shown arranged vertically. The interaction of stacking locators 13 and stacking lugs 17 of adjacent multi-well plate covers 1 provides stability and geometric alignment of the stack. The covered multi-well plate 5 is normally stored in storage units that are robotic material handling systems. Geometrically constrained stacks are important to the pick and place robotic manipulation.

What is claimed is:

1. A cover for operative sealing securement to a multi-well plate comprising a surface defining a plurality of wells therein, the cover comprising:

a lid sized to overlie the multi-well plate, the lid comprising:

a curvilinear upper section;

opposed first and second parallel longitudinal side walls, a gasket fixed to the underside of said upper section;

the curvilinear upper section dimensioned to overlie the multi-well plate surface and formed of a resiliently flexible material, the curvilinear upper section having a concave shape in an initial, un-flexed position along a transverse cross-section along its entire length between said pair of opposed side walls, and the first and second side walls, respectively, comprising opposed first and second ends, the first end of each side wall integrally depending from a respective peripheral side of the upper section of the lid and extending substantially perpendicular to the upper section of the lid, each of the first and second side walls comprising at least one lateral projection extending directly from a lower edge of the sidewalls, respectively, to face laterally inwardly towards the respective other side wall of the first and second side walls for grasping engagement with a lower surface of the multi-well plate to secure the lid sealingly to the multi-well plate, the side walls and upper section being sufficiently resiliently flexible for flexing the side walls from:

a first at rest position wherein the upper section is in the initial, unflexed position and at least one lateral projection of the first side wall is a predetermined distance apart from at least one lateral projection of the second side wall, to a second position wherein at least one said lateral projection of the first side wall and at least one said lateral projection of the second side wall are sufficiently further apart than in the first at rest position for flexing the side walls about the multi-well plate when the lid is placed above an upper surface of the multi-well plate, to a third grasping position wherein the lateral projections extend under the lower surface of the multi-well plate and the at least one lateral projection of the first side wall and the at least one lateral projection of the second side wall are closer than in the second position and the upper section is in a final, flexed position, and the upper section is sufficiently resiliently flexible for permitting the curvilinear concave shaped upper section to resiliently deform to straighten when the lid is positioned above the surface of the multi-well plate and downward force is applied to the lid to press the gasket against an upper surface of the multi-well plate; and the gasket fixed to an underside of the lid and dimensioned to compressingly abut the upper surface of the multi-well plate when the lid is sealingly secured to the multi-well plate and seal the wells against ingress and egress of fluids and materials when the lid is sealingly secured to the multi-well plate;

the first side wall and second side wall extend downwardly from the top cover a sufficient length for the lateral projections to contact the lower surface of the multi-well plate in the third grasping position.

2. The cover of claim 1, wherein the side walls further comprise notched tabs with locator holes for facilitating the gripping of the cover by mechanical handling apparatus.

3. The cover of claim 1, wherein the side walls further comprise stacking lugs projecting downward from the side walls lower edges, respectively, a distance lower than the lateral projections.

4. The cover of claim 1, wherein the side walls further comprise means for laterally and longitudinally aligning the cover with an adjacent cover when the cover is in a stack of like covers.

5. The cover of claim 3, wherein the side walls further comprise stacking locators positioned in the side walls, the stacking locators being positioned to engage the stacking lugs of an adjacent cover for laterally and longitudinally aligning the cover with the adjacent cover when the cover is in a stack of like covers.

6. The cover of claim 3, wherein the side walls define slots positioned in the side walls to engage the stacking lugs of an adjacent cover for laterally and longitudinally aligning the cover with the adjacent cover when the cover is in a stack of like covers.

7. The cover of claim 1, wherein each side wall comprises a clamp for engaging an edge of the multi-well plate, the clamp being located on the side wall second end.

8. The cover of claim 1, wherein the gasket comprises a thermoplastic polymer having a durometer of Shore 15A and having a high degree of chemical resistance to dimethyl sulfoxide.

9. The cover of claim 1, wherein the gasket comprises an elastomer having a durometer of Shore 15A and having a high degree of chemical resistance to dimethyl sulfoxide.

10. The cover of claim 1, wherein the lid is formed of a material selected from the group consisting of steel, stainless steel, spring steel and stainless spring steel, and has a thickness of between about 0.015" and about 0.024".

11. An assembly of a multi-well plate and a cover for the multi-well plate, wherein:

the plate comprises an upper surface, a plurality of wells having openings disposed in the upper surface, and a skirt disposed on an edge of the plate; and a cover for operative sealing securement to a multi-well plate comprising a surface defining said plurality of wells therein, the cover comprising:

a lid sized to overlie the multi-well plate, the lid comprising:

a curvilinear upper section;

opposed first and second parallel longitudinal side walls, a gasket fixed to the underside of said upper section;

the curvilinear upper section dimensioned to overlie the multi-well plate surface and formed of a resiliently flexible material, the curvilinear upper section having a concave shape in an initial, un-flexed position along a transverse cross-section along its entire length between said pair of opposed side walls, and the first and second side walls, respectively, comprising opposed first and second ends, the first end of each side wall integrally depending from a respective peripheral side of the upper section of the lid and extending substantially perpendicular to the upper section of the lid, each of the first and second side walls comprising at least one lateral projection extending directly from a lower edge of the sidewalls, respectively, to face laterally inwardly towards the respective other side wall of the first and second side walls for grasping engagement with a lower surface of the multi-well plate to secure the lid sealingly to the multi-well plate, the side walls and upper section being sufficiently resiliently flexible for flexing the side walls from:

a first at rest position wherein the upper section is in the initial, unflexed position and at least one lateral projection of the first side wall is a predetermined distance apart from at least one lateral projection of the second side wall, to a second position wherein at least one said lateral projection of the first side wall and at least one said lateral projection of the second side wall are sufficiently further apart than in the first at rest position for flexing the side walls about the multi-well plate when the lid is placed above an upper surface of the multi-well plate, to a third grasping position wherein the lateral projections extend under the lower surface of the multi-well plate and the at least one lateral projection of the first side wall and the at least one lateral projection of the second side wall are closer than in the second position and the upper section is in a final, flexed position, and the upper section is sufficiently resiliently flexible for permitting the curvilinear concave shaped upper section to resiliently deform to straighten when the lid is positioned above the surface of the multi-well plate and downward force is applied to the lid to press the gasket against an upper surface of the multi-well plate; and the gasket fixed to an underside of the lid and dimensioned to compressingly abut the upper surface of the multi-well plate when the lid is sealingly secured to the multi-well plate and seal the wells against ingress and egress of fluids and materials when the lid is sealingly secured to the multi-well plate;

the first side wall and second side wall extend downwardly from the top cover a sufficient length for the lateral projections to contact the lower surface of the multi-well plate in the third grasping position; and wherein the upper section has opposed peripheral longitudinal sides integral with said sidewalls respectively, and wherein the lateral projections are located a sufficient distance below an upper edge of the respective sidewall for urging the opposed peripheral longitudinal sides of the lid towards the upper surface of the plate to compress the gasket between the underside of the lid and the upper surface of the multi-well plate when the side walls are in the third grasping position.

12. The assembly of claim 11, wherein the side walls further comprise stacking lugs projecting downward from the side walls lower edges, respectively, a distance lower than the lateral projections.

13. The assembly of claim 11, wherein the curvilinear upper section of the lid is sufficiently curved for spacing opposed peripheral longitudinal side portions of the surface of the gasket facing the upper surface of the multi-well plate from the upper surface of the multi-well plate when an intermediate portion of the surface of the gasket facing the upper surface of the multi-well plate contacts the upper surface of the multi-well plate when the curvilinear upper section is at rest.

14. The assembly of claim 12, wherein the side walls further comprise stacking locators positioned in the side walls, the stacking locators being positioned to engage the stacking lugs of the adjacent cover.

15. The assembly of claim 12, wherein the side walls define slots positioned in the side walls to engage the stacking lugs of the adjacent cover.

16. The assembly of claim 12, wherein each lateral projection comprises a convex portion having a transverse convex cross-section, the topmost peak of the convex portion being higher than a location from which the lateral projection initially extends from the side wall.

17. The assembly of claim 12, wherein the innermost end of the lateral projection points downwardly.

18. The cover of claim 1, wherein each lateral projection comprises a convex portion having a transverse convex cross-section, the topmost peak of the convex portion being higher than a location from which the lateral projection initially extends from the side wall.

19. The cover of claim 1, wherein the innermost end of the lateral projection points downwardly.

20. A cover for operative sealing securement to a multi-well plate comprising a surface defining a plurality of wells therein, the cover comprising:

a lid sized to overlie the multi-well plate, the lid comprising:

a curvilinear upper section;

opposed first and second parallel longitudinal side walls, a gasket fixed to the underside of said upper section;

the curvilinear upper section dimensioned to overlie the multi-well plate surface and formed of a resiliently flexible material, the curvilinear upper section having a concave shape in an initial, un-flexed position along a transverse cross-section along its entire length between said pair of opposed side walls, and the first and second side walls, respectively, comprising opposed first and second ends, the first end of each side wall integrally depending from a respective peripheral side of the upper section of the lid and extending substantially perpendicular to the upper section of the lid, each of the first and second side walls comprising at least one lateral projection extending directly from the sidewalls, respectively, to face laterally inwardly towards the respective other side wall of the first and second side walls for grasping engagement with the multi-well plate to secure the lid sealingly to the multi-well plate, the side walls and upper section being sufficiently resiliently flexible for flexing the side walls from:

a first at rest position wherein the upper section is in the initial, unflexed position and at least one lateral projection of the first side wall is a predetermined distance apart from at least one lateral projection of the second side wall, to a second position wherein at least one said lateral projection of the first side wall and at least one said lateral projection of the second side wall are sufficiently further apart than in the first at rest position for flexing the side walls about the multi-well plate when the lid is placed above an upper surface of the multi-well plate, to a third grasping position wherein the lateral projections grasp the multi-well plate and the at least one lateral projection of the first side wall and the at least one lateral projection of the second side wall are closer than in the second position and the upper section is in a final, flexed position, and the upper section is sufficiently resiliently flexible for permitting the curvilinear concave shaped upper section to resiliently deform to straighten when the lid is positioned above the surface of the multi-well plate and downward force is applied to the lid to press the gasket against an upper surface of the multi-well plate; and the gasket fixed to an underside of the lid and dimensioned to compressingly abut the upper surface of the multi-well plate when the lid is sealingly secured to the multi-well plate and seal the wells against ingress and egress of fluids and materials when the lid is sealingly secured to the multi-well plate;

wherein each said side wall further comprises at least one stacking lug projecting downward from a lower edge of the respective side wall a distance lower than the respective at least one lateral projection.

21. The cover of claim 20, wherein the side walls further comprise stacking locators positioned in the side walls, the stacking locators being positioned to engage the stacking lugs of the adjacent cover.

22. The cover of claim 20, wherein the side walls define slots positioned in the side walls to engage the stacking lugs of the adjacent cover.

23. An assembly of a multi-well plate and a cover for the multi-well plate, wherein:

the plate comprises an upper surface, a plurality of wells having openings disposed in the upper surface, and a skirt disposed on an edge of the plate; and a cover for operative sealing securement to a multi-well plate comprising a surface defining said plurality of wells therein, the cover comprising:

a lid sized to overlie the multi-well plate, the lid comprising:

a curvilinear upper section;

opposed first and second parallel longitudinal side walls, a gasket fixed to the underside of said upper section;

the curvilinear upper section dimensioned to overlie the multi-well plate surface and formed of a resiliently flexible material, the curvilinear upper section having a concave shape in an initial, un-flexed position along a transverse cross-section along its entire length between said pair of opposed side walls, and the first and second side walls, respectively, comprising opposed first and second ends, the first end of each side wall integrally depending from a respective peripheral side of the upper section of the lid and extending substantially perpendicular to the upper section of the lid, each of the first and second side walls comprising at least one lateral projection extending directly from the sidewalls, respectively, to face laterally inwardly towards the respective other side wall of the first and second side walls for grasping engagement with the multi-well plate to secure the lid sealingly to the multi-well plate, the side walls and upper section being sufficiently resiliently flexible for flexing the side walls from:

a first at rest position wherein the upper section is in the initial, unflexed position and at least one lateral projection of the first side wall is a predetermined distance apart from at least one lateral projection of the second side wall, to a second position wherein at least one said lateral projection of the first side wall and at least one said lateral projection of the second side wall are sufficiently further apart than in the first at rest position for flexing the side walls about the multi-well plate when the lid is placed above an upper surface of the multi-well plate, to a third grasping position wherein the lateral projections grasp the multi-well plate and the at least one lateral projection of the first side wall and the at least one lateral projection of the second side wall are closer than in the second position and the upper section is in a final, flexed position, and the upper section is sufficiently resiliently flexible for permitting the curvilinear concave shaped upper section to resiliently deform to straighten when the lid is positioned above the surface of the multi-well plate and downward force is applied to the lid to press the gasket against an upper surface of the multi-well plate; and the gasket fixed to an underside of the lid and dimensioned to compressingly abut the upper surface of the multi-well plate when the lid is sealingly secured to the multi-well plate and seal the wells against ingress and egress of fluids and materials when the lid is sealingly secured to the multi-well plate;

wherein each said side wall further comprises at least one stacking lug projecting downward from a lower edge of the respective side wall a distance lower than the respective at least one lateral projection; and wherein the upper section has opposed peripheral longitudinal sides integral with said sidewalls respectively, and wherein the lateral projections are located a sufficient distance below an upper edge of the respective sidewall for urging the opposed peripheral longitudinal sides of the lid towards the upper surface of the plate to compress the gasket between the underside of the lid and the upper surface of the multi-well plate when the side walls are in the third grasping position.

24. The cover of claim 23, wherein the side walls further comprise stacking locators positioned in the side walls, the stacking locators being positioned to engage the stacking lugs of the adjacent cover.

25. The cover of claim 23, wherein the side walls define slots positioned in the side walls to engage the stacking lugs of the adjacent cover.

* * * * *